US006684800B2

(12) United States Patent
Matsuda et al.

(10) Patent No.: US 6,684,800 B2
(45) Date of Patent: Feb. 3, 2004

(54) PERSONAL WATERCRAFT

(75) Inventors: Yoshimoto Matsuda, Hyogo (JP); Yasuo Okada, Hyogo (JP); Yoshinobu Tanaka, Hyogo (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/215,283

(22) Filed: Aug. 8, 2002

(65) Prior Publication Data

US 2003/0029366 A1 Feb. 13, 2003

(30) Foreign Application Priority Data

Aug. 13, 2001 (JP) ..... 2001-245291

(51) Int. Cl.[7] ..... B63B 35/73
(52) U.S. Cl. ..... 114/55.5; 440/88 F

(58) Field of Search ..... 114/55.5; 440/88 F

(56) References Cited

U.S. PATENT DOCUMENTS 6,170,470 B1 * 1/2001 Clarkson et al. ..... 123/497
6,527,603 B1 * 3/2003 Wickman et al. ..... 123/509

* cited by examiner

*Primary Examiner*—Jesus D. Sotelo
(74) *Attorney, Agent, or Firm*—Marshall, Gerstein & Borun LLP

(57) ABSTRACT

Disclosed is a personal watercraft capable of separating and eliminating water contained in fuel without inspecting whether or not the water is present in a fuel tank. The personal watercraft comprises a water separator 21 in a fuel supply passage from a fuel tank 14 for reserving fuel supplied to an internal combustion engine 4 to an air-fuel mixture generating means 17 for mixing fuel with air to generate air-fuel mixture.

6 Claims, 8 Drawing Sheets

PERSONAL WATERCRAFT

BACKGROUND OF THE INVENTION

1. Field of the Invention

The present invention relates to a personal watercraft (PWC) which ejects water rearward and planes on a water surface as the resulting reaction, and more particularly to a personal watercraft having a system of separating and eliminating water contained in fuel from the fuel.

2. Description of the Related Art

In recent years, personal watercraft have been widely used in leisure, sport, rescue activities, and the like. The personal watercraft has a straddle-type body structure, and is configured to have a water jet pump that pressurizes and accelerates water sucked from a water intake generally provided on a hull bottom surface and ejects it rearward from an outlet port. Thereby, the personal watercraft is propelled. The personal watercraft is equipped with an engine as a power source for driving the water jet pump, a fuel tank for reserving fuel (gasoline) supplied to the engine, and the like, inside of an outer shell of the body.

In such personal watercraft, the fuel is commonly fed into the fuel tank at the waterside or on the water. Therefore, water ingress into the fuel tank is sometimes caused by water splashes to the fuel tank during fuel feeding. When the fuel containing water is supplied to the engine, engine power efficiency is reduced.

In the conventional personal watercraft, the fuel tank is made of semi-transparent resin so that the inside thereof is visible from outside. Inside the fuel tank, the water tends to move downwardly to the bottom because of its specific gravity higher than the specific gravity of the fuel. The water in the fuel tank is detected by visual inspection from outside. After being detected, the water is discharged, together with the fuel, from the fuel tank.

However, since the fuel tank is placed inside of the body, it is not easy to detect whether or not the water is present in the fuel tank by visual inspection. When the water is detected, the fuel needs to be discharged, which work is burdensome.

SUMMARY OF THE INVENTION

The present invention address the above-described condition, and an object of the present invention is to provide a personal watercraft capable of separating and eliminating water contained in fuel without inspecting whether or not the water is present in a fuel tank.

According to the present invention, there is provided a personal watercraft comprising: an internal combustion engine; a fuel tank for reserving fuel supplied to the internal combustion engine; an air-fuel mixture generating means for mixing the fuel from the fuel tank with air to generate air-fuel mixture; a fuel supply passage connecting the fuel tank to the air-fuel mixture generating means; and a water separator provided in the fuel supply passage.

In the personal watercraft so constituted, the water contained in the fuel in the fuel tank can be separated and eliminated from the fuel by using the water separator. Thereby, the fuel nearly free from water can be supplied to the internal combustion engine, and consequently, a power efficiency of the internal combustion engine is not reduced. The elimination of water is accomplished merely by discharging the separated water from the water separator, without regularly inspecting whether or not the water is present in the fuel tank. In addition, it is not necessary to discharge the fuel from the fuel tank when the fuel contains the water.

The personal watercraft may further comprise a body member to which the water separator is removably mounted, and the water separator may comprise a container for reserving the fuel and a cap member removably attached to the container, for covering an opening in the container. With such constitution, since the water separator can be removed from the body and the cap member can be detached from the container, the water in the water separator can be easily discharged.

The personal watercraft may further comprise: a cover member, the cover member being adapted to cover a portion where the water separator is mounted and expose the portion where the water separator is mounted. Since the cover member can cover the portion where the water separator is mounted, the body's external appearance is visually favorable.

In the personal watercraft, when the cover member covers the portion where the water separator is mounted, the cap member may be in contact with a inner face of the cover member or in close proximity to the inner face of the cover member with a slight gap.

In this constitution, when the cap member is not firmly attached to the container, complete covering by the cover member is unfulfilled. From the incomplete covering by the cover member, the user finds that the cap member is not firmly attached to the container.

The personal watercraft may further comprise: a body member provided with an opening capable of being covered and uncovered, and the water separator may be removably mounted inside of the body member in the vicinity of the opening, and the water separator may comprise a container for reserving the fuel and a cap member removably attached to the container, for covering an opening in the container. Thereby, the rider (operator) can easily make access to the water separator by uncovering the opening, and then remove the water separator from the body and remove the cap member from the container. In this manner, the water in the water separator can be discharged.

The personal watercraft may further comprise: a discharge passage; and an opening/closing means for opening/closing the discharge passage, and the water separator may have a container for reserving the fuel, and the discharge passage may be provided at a bottom of the container. With such constitution, by opening the opening/closing means, the water in the container can be discharged outside the watercraft. This eliminates the need for removal of the water separator from the body.

The personal watercraft may further comprise: a biasing means for biasing the opening/closing means to be at a closed position; and an operating means for opening the opening/closing means against a biasing force of the biasing means.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described in detail with reference to the accompanying drawings.

First Embodiment

Figure 1:
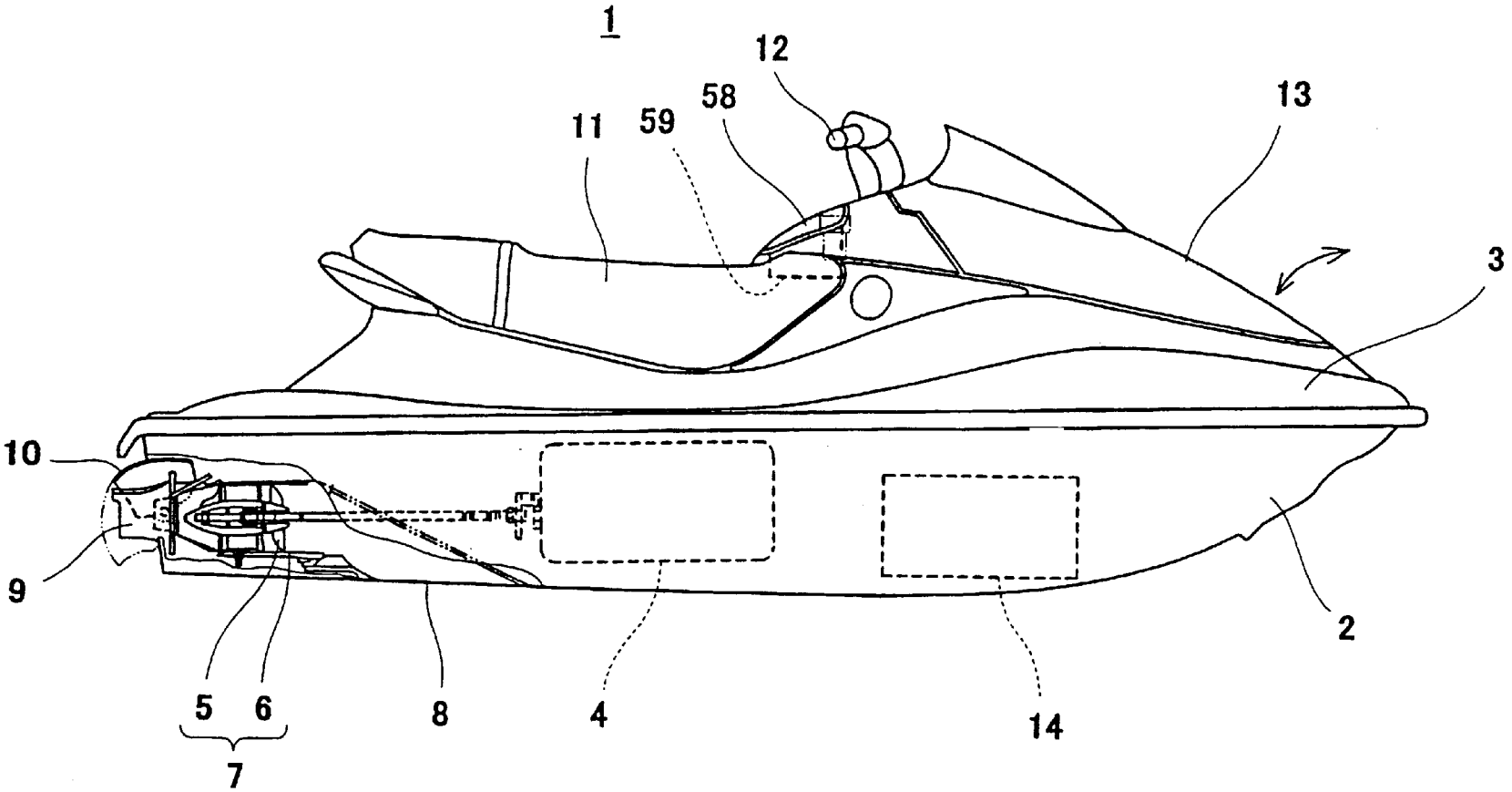
FIG. 1 is a side view showing a personal watercraft according to a first embodiment of the present invention.

FIG. 1 is a side view of a personal watercraft 1 according to a first embodiment of the present invention.

The personal watercraft 1 has a FRP body. The body is mainly comprised of a hull 2 and a deck 3 covering the hull 2 from above. The hull 2 and the deck 3 are body members. An engine (internal combustion engine) 4 as a power source is equipped inside of the body comprised of the hull 2 and the deck 3. The rotation of the engine 4 is transmitted to an impeller 5 through a drive shaft. The impeller 5 and a casing 6 enclosing outer periphery of the impeller 5 constitute a water jet pump 7.

An opening is provided as a water intake 8 in a bottom surface of the hull 2. The water is sucked from the water intake 8 and fed to the water jet pump 7. The water jet pump 7 pressurizes and accelerates the water. The pressurized and accelerated water is discharged through a pump nozzle behind the water jet pump 7, thereby propelling the personal watercraft 1. The pump nozzle is covered with a steering nozzle 9 provided behind the pump nozzle. In FIG. 1, reference numeral 10 denotes a reverse deflector. The deflector 10 is swung downward to a lower position around a horizontally mounted swinging shaft to deflect the ejected water from the steering nozzle 9 forward, and as the resulting reaction, the personal watercraft 1 moves rearward.

A straddle-type seat 11 is mounted at the center portion of the deck 3. A steering handle 12 is provided in front of the seat 11. When the rider steers the steering handle 12 clockwise or counterclockwise, the steering nozzle 9 is swung toward the opposite direction so that the watercraft 1 can be correspondingly turned to a desired direction. A hatch cover 13 is mounted in front of the handle 12 so as to partially cover the deck 3. A box cover 58 is mounted behind the handle 12 so as to cover an accommodating portion 59 provided in the deck 3.

The seat 11 is removable from the deck 3. When the rider is driving the watercraft 1, the seat 11 is mounted on the deck 3. During maintenance of a propulsion device or the like located inside of the body, the seat 11 is removed from the deck 3. By removing the seat 11, an opening formed in the deck 3 is exposed, and maintenance works or the like of the internal combustion engine or the like can be carried out through the opening.

The hatch cover 13 is openable/closable as indicated by an arrow 3 in FIG. 1. To be specific, the hatch cover 13 is pivotally attached to the deck 3 around its tip end as a pivot axis. By opening the hatch cover 13, an opening formed in the deck 3 is exposed. The inner space of the opening is utilized for accommodating equipment and the like.

The box cover 58 is openably attached to the deck 3. By opening the box cover 58, the accommodating portion 59 is exposed.

A fuel tank 14 made of resin is provided inside of the body comprised of the hull 2 and the deck 3. The role of the fuel tank 14 is to reserve the fuel to be supplied to the engine 4.

Figure 2:
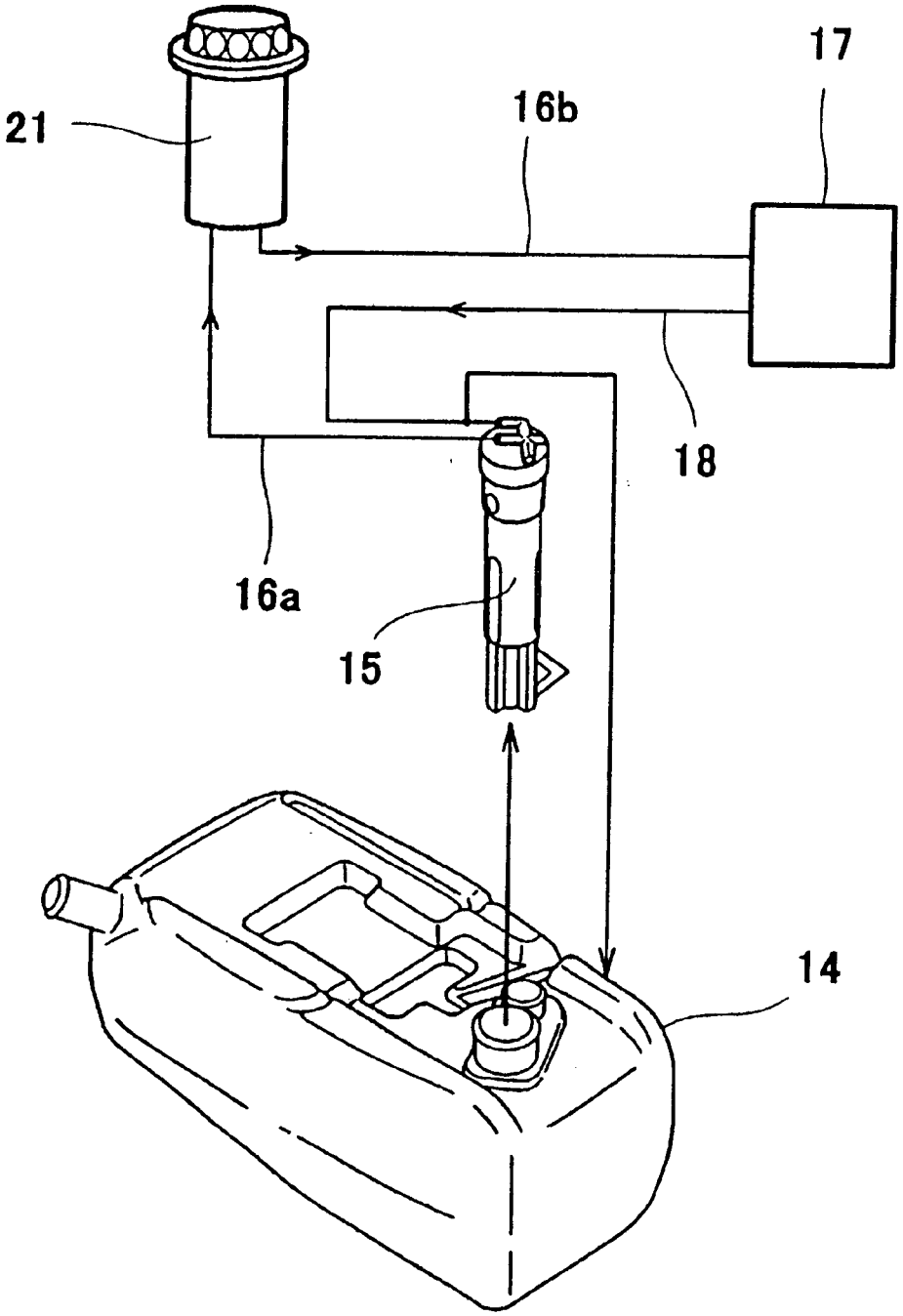
FIG. 2 is a view of a fuel supply system of the personal watercraft in FIG. 1.

FIG. 2 is a schematic view of a fuel supply system installed in the personal watercraft 1. A fuel pump 15 is mounted to the fuel tank 14. The fuel reserved in the fuel tank 14 is pumped into an air-fuel mixture generating means 17 by a fuel pump 15 through a fuel supply passage. As defined herein, the "air-fuel mixture generating means" refers to a means for mixing air with fuel to generate air-fuel mixture. For example, a carburetor, a fuel injector, or the like corresponds to the "air-fuel mixture generating means." The excess fuel which has not been supplied into a combustion chamber of the engine 4 is returned into the fuel tank 14 through a return pipe 18.

A water separator 21 is provided in the fuel supply passage connecting the fuel pump 15 to the air-fuel mixture generating means 17, for the purpose of separating water contained in the fuel. The fuel from the fuel pump 15 is led to the water separator 21 through a pipe 16*a* and then to the air-fuel mixture generating means 17 through a pipe 16*b*. The water separator 21 serves to separate the water from the fuel by specific gravity difference between the fuel and the water.

Figure 3:
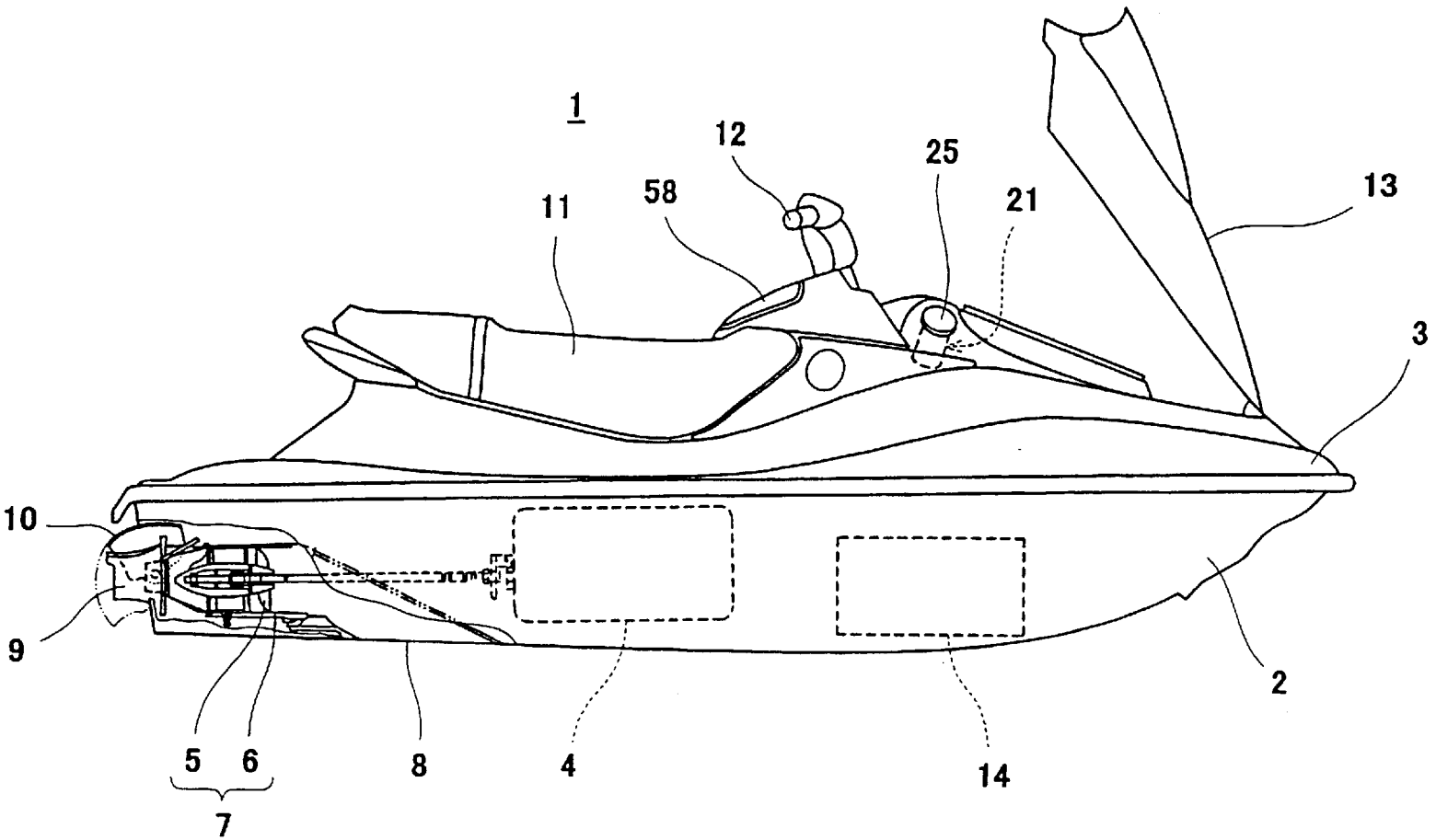
FIG. 3 is a side view of the personal watercraft in FIG. 1, with a hatch cover being at an open position.

FIG. 3 is a side view of the personal watercraft 1 with the hatch cover 13 being at an open position. The water separator 21 is mounted to the deck 3. A portion of the deck 3 where the water separator 21 is mounted is covered with the hatch cover 13 by closing hatch cover 13, and uncovered by opening the hatch cover 13. The hatch cover 13 functions as a cover member provided over the water separator 21.

As clearly shown in FIG. 3, when the hatch cover 13 is opened, a cap member 25 of the water separator 21 mounted to the deck 3 is exposed. Conversely, when the hatch cover 13 is closed, the water separator 21 is covered with the hatch cover 13. Therefore, the external appearance of the body of the watercraft 1 is visually favorable.

Figure 4:
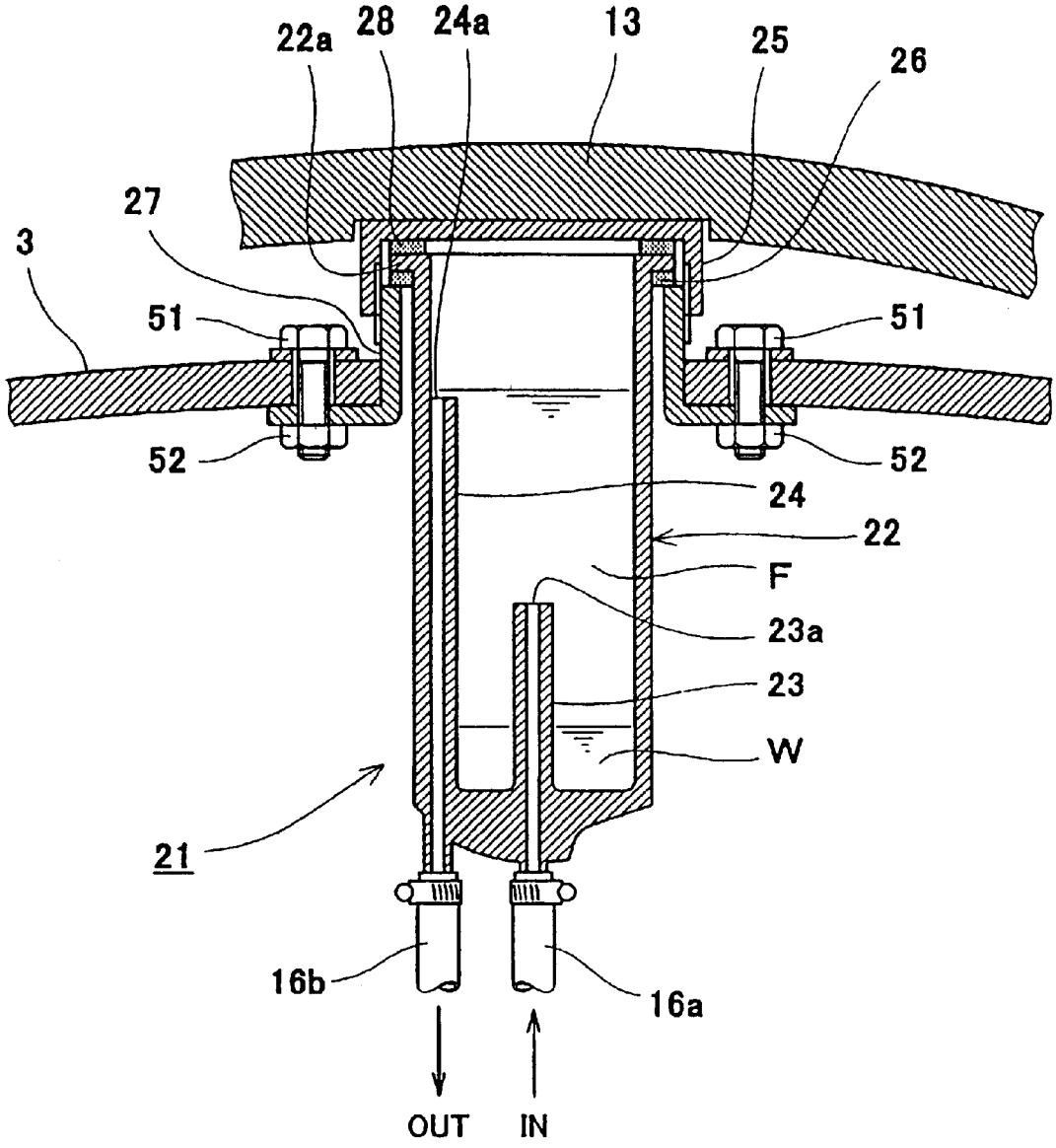
FIG. 4 is a longitudinal sectional view of a water separator.

FIG. 4 is a longitudinal sectional view of the water separator 21. FIG. 4 shows a structure of the water separator 21 and a structure of mounting of the water separator 21 to the deck 3.

The water separator 21 is mainly comprised of a substantially cylindrical container 22 and the cap member 25. The container 22 has a required volume and its upper end is opened. The container 22 is made of semi-transparent resin. The cap member 25 covers the opening in the upper end of the container 25.

The water separator 21 is mounted to the deck 3. A tubular support member 27 is secured to the deck 3 by means of a bolt 51 and a nut 52 such that the member 27 penetrates the deck 3 through a circular hole portion formed in the deck 3. The outer diameter of the container 22 is slightly smaller than the inner diameter of the support member 27. The water separator 21 is mounted so as to extend along the inner inside of the support member 27. A flange 22*a* outwardly extends in a radial direction at the upper end of the container 22. Because the outer diameter of the flange 22*a* is larger than the inner diameter of the support member 27, the container 22 is supported by the support member 27. The cap member 25 is screwed to the support member 27. To be specific, a female screw is formed on an inner peripheral face of the cap member 25 and a male screw is formed on an outer peripheral face of the support member 27 in the vicinity of the upper end. The female screw of the cap member 25 and the male screw of the support member 27 are threadedly engaged. The flange 22*a* is securely retained between the cap member 25 and the support member 27 to allow the container 22 to be secured to the deck 3. A gasket 26 is provided between the support member 27 and the flange 22*a* and a gasket 28 is provided between the cap member 25 and the flange 22*a*. In this manner, the opening in the upper end of the container 22 is covered with the cap member 25.

The hatch cover 13 covers the cap member 25 from above. The hatch cover 13 is in contact with or in close proximity to the cap member 25. In other words, there is no or slight gap between the upper face of the cap member 25 and the rear face of the hatch cover 13.

The container 22 is provided with a fuel inflow pipe 23 and a fuel outflow pipe 24. The fuel inflow pipe 23 serves to lead the fuel from the outside of the container 22 to the inside thereof and is connected to the pipe 16*a*. The fuel inflow pipe 23 has an opening 23*a* inside of the container 22 at a position spaced a predetermined distance above the bottom. The fuel outflow pipe 24 serves to lead the fuel from the inside of the container 22 to the outside thereof and is connected to the pipe 16*b*. The fuel outflow pipe 24 has an opening 24*a* inside of the container 22 at a position higher than the position of the opening 23*a* of the fuel inflow pipe 23.

The fuel in the fuel tank 14 is pumped into the container 22 by the fuel pump 15 through the pipe 16*a* and the fuel inflow pipe 23. When the fuel containing water flows into the container 22, the water is spontaneously separated from the fuel in the container 22 due to specific gravity difference between the water and the fuel and moves downwardly to the bottom of the container 22. In FIG. 4, W denotes the water collected in the bottom of the container 22 and F denotes the fuel overlying the water.

The fuel, from which the water has been separated in the water separator 21 flows from the opening 24*a* of the fuel outflow pipe 24 into the fuel outflow pipe 24. Then, the fuel is led to the outside of the container 22 through the fuel outflow pipe 24. Further, the fuel is led to the air-fuel mixture generating means 17 through the pipe 16*b*.

As should be appreciated from the foregoing, the water separator 21 is provided in the fuel supply passage connecting the fuel tank 14 to the air-fuel mixture generating means 17, for the purpose of separating the water contained in the fuel. Therefore, the fuel nearly free from water can be supplied to the engine 4. Consequently, a power efficiency of the engine 4 is not reduced.

When it is detected that some amount of water is present inside of the water separator 21, it becomes necessary to discharge the water. The water in the water separator 21 can be detected by regular visual inspection, or otherwise by using a water sensor provided in the water separator 21. Since the water separator 21 is removably mounted to the deck 3, the water separator 21 can be removed from the deck 3 and then the water is discharged from the water separator 21. When removing the water separator 21 from the deck 3, first of all, the hatch cover 13 is opened, thereby exposing the portion of the deck 3 where the water separator 21 is mounted. Following this, the cap member 25 screwed to the support member 27 is detached from the support member 27. Then, the container 22 supported by the support member 27 is lifted up from the support member 27, with the pipes 16*a*, 16*b* being connected to the container 22. Then, the container 22 is tilted or inverted, thereby discharging the water in the container 22 with the fuel. It should be appreciated that the container 22 is preferably kept away from the body of the watercraft 1 during the discharge of the water and the fuel in order to prevent the body, for example, the deck 3, from being contaminated.

Thereby, the water is emptied out of the container 22. Thereafter, the water separator 21 is re-mounted to the deck 3 in the reverse order of that for removing the water separator 21 from the deck 3.

When re-mounting the water separator 21 to the deck 3, the hatch cover 13 can be fully closed in the state in which the cap member 25 is firmly fastened to the support member 27. Conversely, when the cap member 25 is not firmly fastened to the support member 27, the hatch cover 13 is incompletely closed. This is because the hatch cover 13 is placed so as to be in contact with or in close proximity to the cap member 25 in the state in which the cap member 25 is firmly fastened to the support member 27. Therefore, the user finds that the cap member 25 is not firmly fastened to the support member 27 when the hatch cover 13 is incompletely closed.

In the embodiment, the water separator 21 is mounted to the portion of the deck 3 which is exposed by opening the hatch cover 13. The portion of the deck 3 where the water separator 21 should be mounted is not intended to be limited to the portion covered with the hatch cover 13. Alternatively, the water separator 21 may be mounted to the portion of the deck 3 which is exposed by removing the seat 11. The portion of the deck 3 which is beneath the seat 11 is covered with the seat 11 in the state in which the seat 11 is mounted on the deck 3 and is exposed by removing the seat 11. Thus, the seat 11 functions as the cover member provided over the water separator 21.

Figure 5:
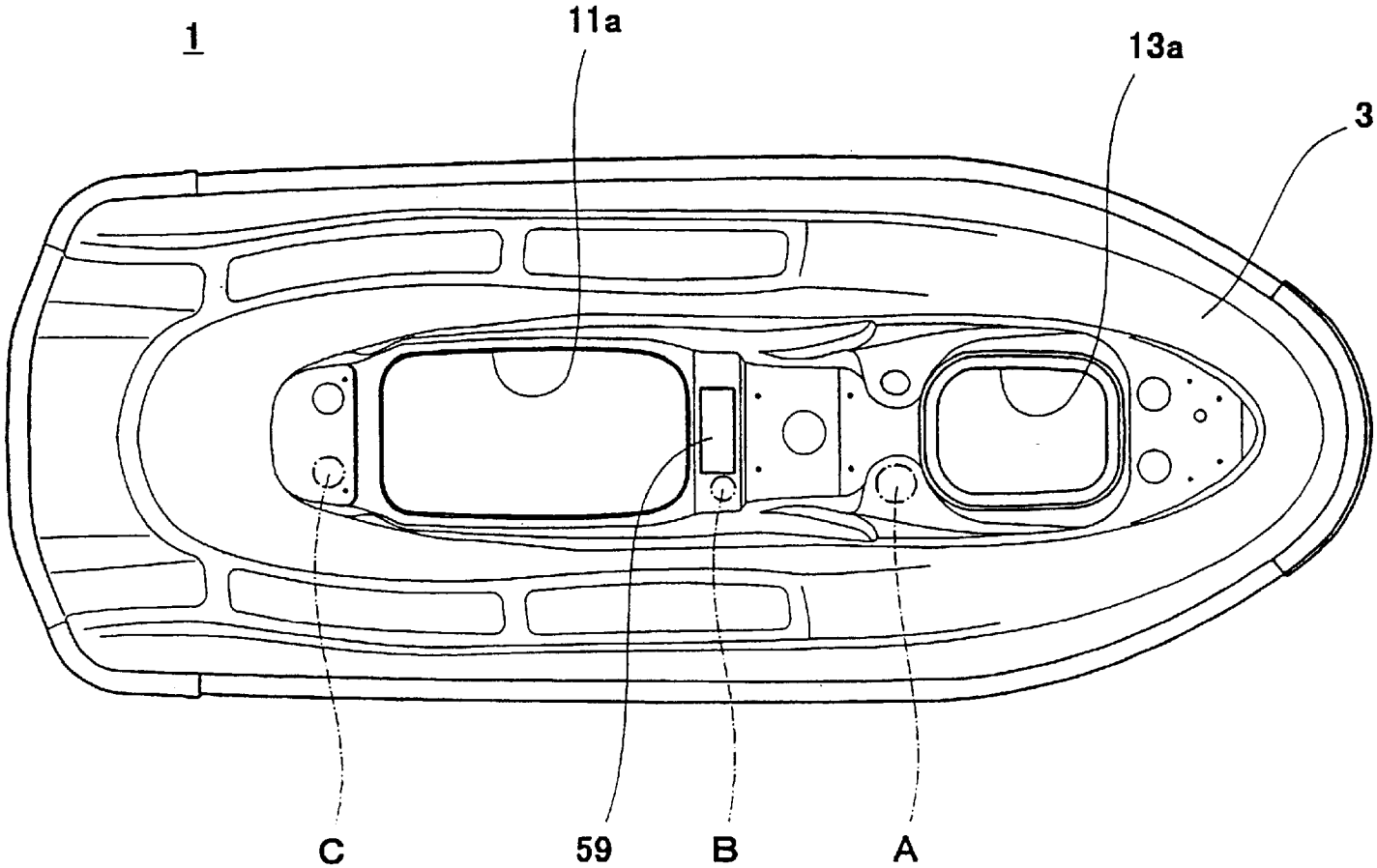
FIG. 5 is a plan view of the personal watercraft in FIG. 1, with a seat, a hatch cover, a box cover, and the like omitted.

FIG. 5 is a plan view of the personal watercraft 1 of FIG. 1, wherein the seat 11, the hatch cover 13, the box cover 58, and the like are removed from the body of the personal watercraft 1. In the embodiment, the water separator 21 is mounted to the portion represented by A in FIG. 5, but may be alternatively mounted to the portion represented by B or C. The portion represented by B is covered with the box cover 58 provided behind the handle 12 in the state in which the box cover 58 is closed. When the water separator 21 is mounted to the portion represented by B, the accommodating portion 59 and the water separator 21 become visible by opening the box cover 58. In FIG. 1, the water separator provided in the vicinity of the accommodating portion 59 is represented by an imaginary line. The portion represented by C is covered with the seat 11 in the state in which the seat 11 is mounted on the deck 3. When the water separator 21 is mounted to the portion represented by C, the water separator 21 is exposed by removing the seat 11. In FIG. 5, 11*a* denotes an opening formed in the deck 3. By removing the seat 11, the opening 11*a* and the water separator 21 provided in the vicinity of the opening 11*a* are exposed. Also, 13*a* denotes an opening formed in the deck 3. By opening the hatch cover 13, the opening 13*a* and the water separator 21 provided in the vicinity of the opening 13*a* are exposed.

The water separator 21 is not necessarily mounted to the portion covered with the cover member, such as the hatch cover 13 or the seat 11, but may be alternatively mounted to the portion being always exposed. The position at which the water separator 21 is mounted to the body is preferably selected in light of desirable external appearance of the watercraft 1.

Embodiment 2

Subsequently, a personal watercraft according to a second embodiment of the present invention will be described. The personal watercraft of the second embodiment is constituted similarly to the personal watercraft 1 of the first embodiment and differs in the structure and mounting position of the water separator from the same.

Figure 6:
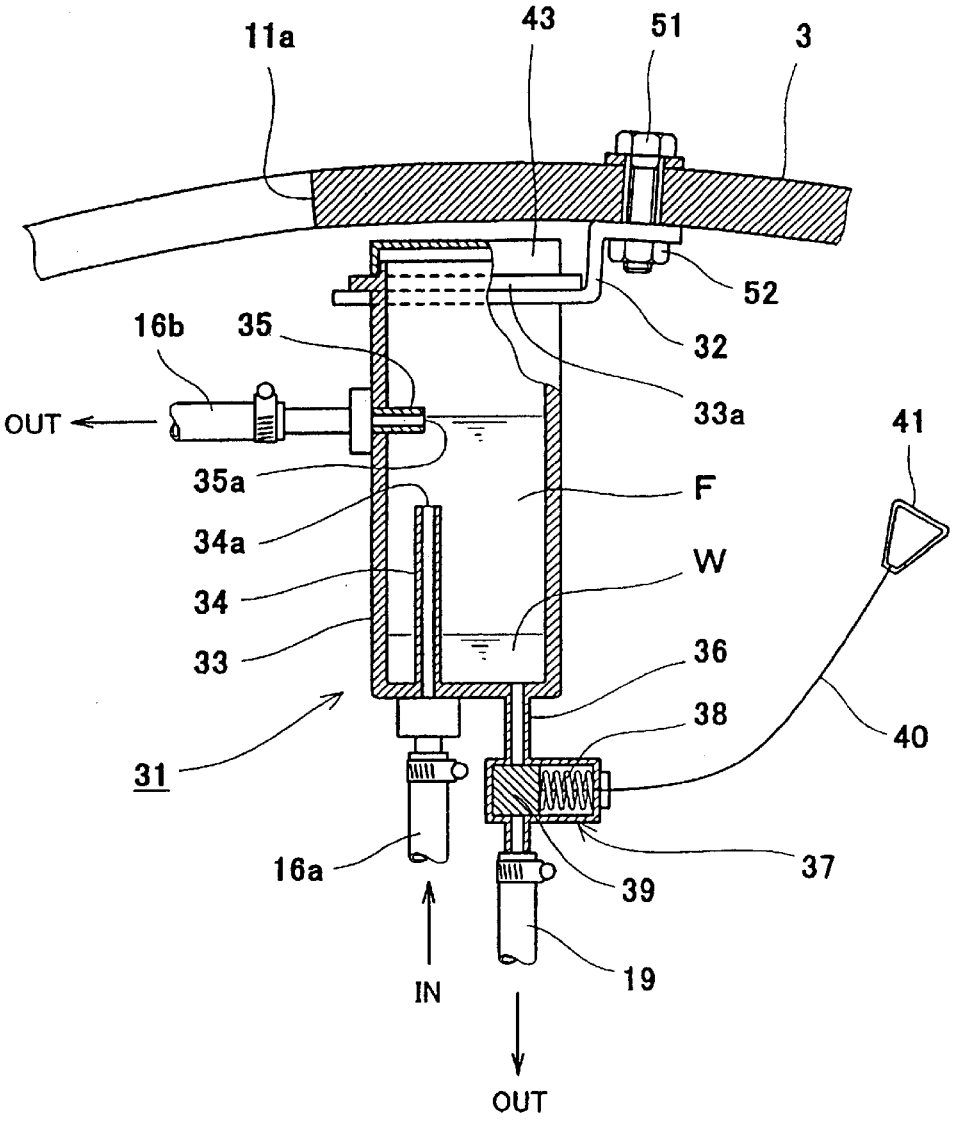
FIG. 6 is a longitudinal sectional view of a water separator of a personal watercraft according to a second embodiment of the present invention.

FIG. 6 is a longitudinal sectional view of the water separator 31 of the personal watercraft according to the second embodiment of the present invention. With reference to FIG. 6, the structure of a water separator 31 and mounting structure of the water separator 31 will be described.

The water separator 31 is mounted at a position in an inner space of the deck 3 that is near the opening 11*a* formed in the deck 3 (see FIG. 5) so as to be accessible from the opening 11*a*. The opening 11*a* is exposed when the seat 11 is removed from the deck 3 (see FIG. 5), and invisible in the state in which the seat 11 is mounted on the deck 3. That is, the opening 11*a* is covered/uncovered by mounting/removing the seat 11. The water separator 31 is removably mounted in the vicinity of the opening 11*a*.

The water separator 31 is mainly comprised of a substantially cylindrical container 33 and a cap member 43. The container 33 has a required volume and its upper end is opened. The container 33 is made of semi-transparent resin. A flange 33*a* outwardly extends in a radial direction in the vicinity of the upper end of the container 33. The cap member 43 covers the opening in the upper end of the container 33. A male screw is formed on an outer peripheral face of the container 33 in the vicinity of the upper end and a female screw is formed on an inner peripheral face of the cap member 43. The female screw of the cap member 43 is threadedly engaged with the male screw of the container 33, thereby attaching the cap member 43 onto the container 33.

The water separator 31 is mounted to the deck 3. A branched member 32 is attached to the deck 3 by means of a bolt 51 and a nut 52. The branched member 32 functions as a support member for supporting the water separator 31 by securely retaining a portion of the container 33 immediately under the flange 33*a*.

Figure 7:
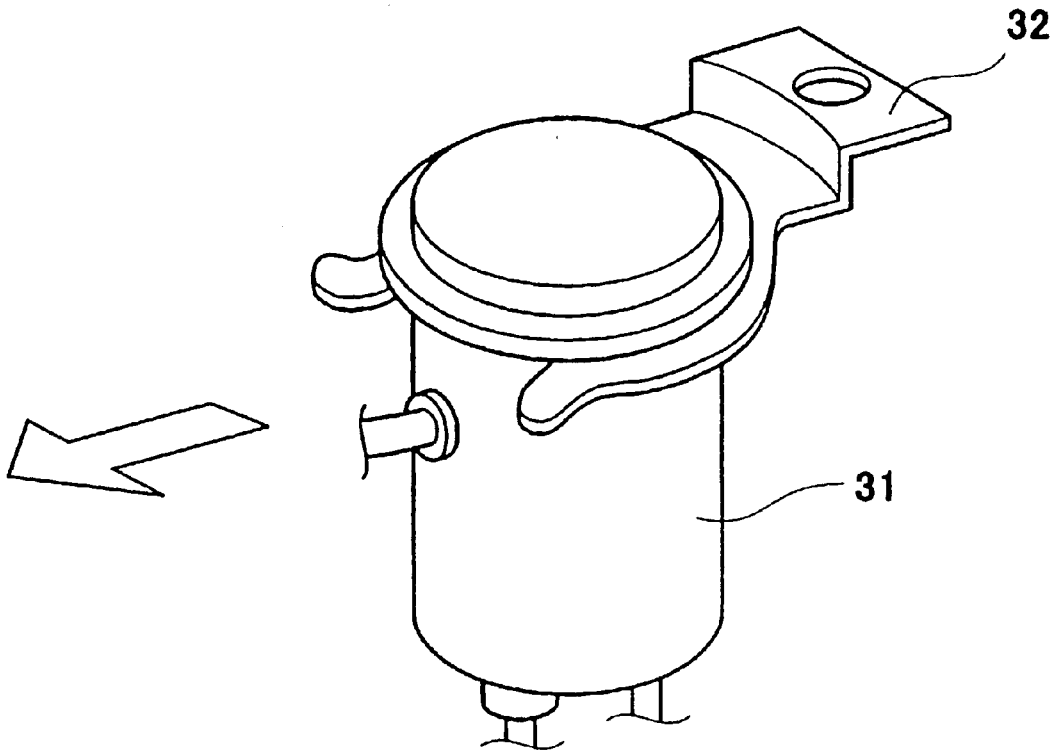
FIG. 7 is a perspective view showing that a branched member supports the water separator.

FIG. 7 is a perspective view showing that the branched member 32 supports the water separator 31. The branched member 32 is made of an elastic material such as steel. When the water separator 31 is pulled toward the direction indicated by an arrow in FIG. 7, the branched member 32 is elastically deformed to be widened, thereby allowing the water separator 31 to be removed from the branched member 32. Conversely, when the removed water separator 31 is pushed against the branched member 32 (toward the opposite direction of the arrow), the branched member 32 is also elastically deformed to be widened, thereby attaching the water separator 31 to the branched member 32.

Referring to FIG. 6 again, the container 33 is engaged with the branched member 32. The water separator 31 has the cap member 43.

The container 33 is provided with a fuel inflow pipe 34 and a fuel outflow pipe 35. The fuel inflow pipe 34 serves to lead the fuel from the outside of the container 33 to the inside thereof and is connected to the pipe 16*a*. The fuel inflow pipe 34 has an opening 34*a* inside of the container 33 at a position spaced a predetermined distance above the bottom. The fuel outflow pipe 35 serves to lead the fuel from the inside of the container 33 to the outside thereof and is connected to the pipe 16*b*. The fuel outflow pipe 35 has an opening 35*a* inside of the container 33 at a position higher than the position of the opening 34*a* of the fuel inflow pipe 34.

The container 33 is provided with a discharge pipe 36 at the bottom. The discharge pipe 36 serves to lead the water at the bottom of the container 33 to the outside. A base end of the discharge pipe 36 is opened in a bottom surface of the container 33 and a tip end of the discharge pipe 36 is connected to a pipe 19.

The discharge pipe 36 is provided with an openable valve 37 as an opening/closing means. The openable valve 37 serves to open/close the discharge pipe 36. A valve plug 39 of the openable valve 37 is biased to be at a closed position by a spring 38. A wire 40 is attached to the openable valve 37, for pulling the valve plug 39 against the bias by the spring 38 to thereby cause the discharge pipe 36 to be opened. A handle 41 is attached to a tip end of the wire 40. The handle 41 may be located at a position in the vicinity of the steering handle 12 of the watercraft so as to be accessible by the rider (operator). The tip end of the pipe 19 extends to a rear end face of the body of the watercraft.

Figure 8:
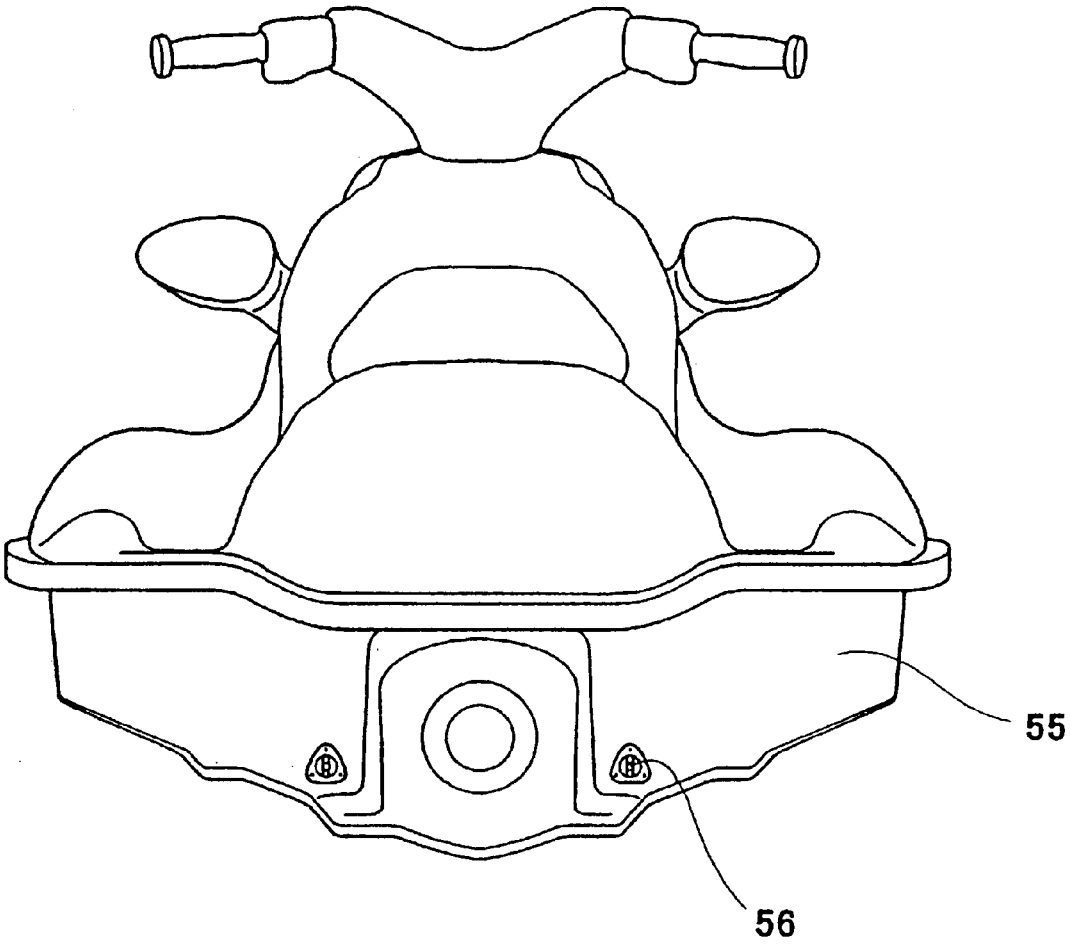
FIG. 8 is a rear view of the personal watercraft in FIG. 6.

FIG. 8 is a rear view of the personal watercraft according to the second embodiment. The tip end of the pipe 19 is connected to a discharge port 56 formed in a rear end face 55 of the personal watercraft. The discharge pipe 36, the pipe 19, and the discharge port 56 constitute a discharge passage.

Referring to FIG. 6 again, the fuel in the fuel tank 14 is pumped into the container 33 by the fuel pump 15 through the pipe 16*a* and the fuel inflow pipe 34. Inside the container 33, the water is separated from the fuel and moves downwardly to the bottom. In FIG. 6, W denotes the water collected in the bottom of the container 33, and F denotes the fuel overlying the water.

The fuel, from which the water has been eliminated, is sent from the opening 35*a* of the fuel outflow pipe 35 to the air-fuel mixture generating means 17 through the fuel outflow pipe 35 and the pipe 16*b*.

When it is detected that some amount of water is present inside of the water separator 31, it becomes necessary to discharge the water. By pulling the handle 41, the water is discharged from the water separator 31. More specifically, by pulling the handle 41, the valve plug 39 moves in a valve chamber against the bias by the spring 38, thus opening the openable valve 37. Thereby, the water at the bottom of the container 33 is discharged from the discharge port 56 formed in the rear end face 55 of the personal watercraft through the discharge pipe 36 and the pipe 19. After fully discharging the water, the handle 41 is released, so that the valve plug 39 moves by the bias by the spring 38, thus closing the openable valve 37.

Thus, by providing the openable valve 37, the water at the bottom of the water separator 31 can be easily discharged outside the watercraft without removing the water separator 31 from the body of the watercraft.

By operating the handle 41, the water can be discharged without the need for the user to touch the openable valve 37. Besides, since the water is discharged from the rear end face 55 of the personal watercraft, the deck 3 or the like of the body is not contaminated. However, a general cock may be used instead of the openable valve 37 in FIG. 6.

It should be appreciated that, without operating the openable valve 37, the water separator 31 may be removed from the body and the water in the container 33 may be discharged, since the water separator 31 is removably mounted to the body. When removing the water separator 31 from the body, first, the seat 11 is removed from the deck 3, thereby exposing the opening 11*a*. Following this, the water separator 31 with the pipes 16*a*, 16*b*, 19 connected thereto, is detached from the branched member 32. Then, the water separator 31 is taken out through the opening 11*a*, and the cap member 43 screwed to the container 33 is detached from the container 33. Thereafter, the container 33 is tilted or inverted, thereby discharging the water in the container 33, with the fuel. Since the water separator 31 is first taken out through the opening 11*a* and then the water or the fuel is discharged outside the watercraft 1.

Thereby, the water is emptied out of the container 33. Thereafter, the water separator 31 is re-mounted to the body in the reverse order of that for removing the water separator 31 from the body.

In the embodiment, the water separator 31 is removably mounted in the vicinity of the opening 11*a* being covered/uncovered by mounting/removing the seat 11. The position of the water separator 31 is not intended to be limited to the vicinity of the opening 11*a* covered by the seat 11. For example, the water separator 31 may be mounted in the vicinity of an opening formed inside of the body, which is covered/uncovered by closing/opening the hatch cover 13, i.e., an opening (see opening 13*a* in FIG. 5) which is formed under the hatch cover 13 and exposed by opening the hatch cover 13.

It should be noted that the openable valve 37 may be dispensed with, and the water separator 31 may be mounted in the position other than the vicinity of the opening in the body member.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

an internal combustion engine;

a fuel tank for reserving fuel supplied to the internal combustion engine;

an air-fuel mixture generating means for mixing the fuel from the fuel tank with air to generate air-fuel mixture;

a fuel supply passage connecting the fuel tank to the air-fuel mixture generating means; and a water separator provided in the fuel supply passage;

said watercraft further comprising: a body member to which the water separator is removably mounted, wherein the water separator comprises a container for reserving the fuel and a cap member removably attached to the container, for covering an opening in the container.

2. The personal watercraft according to claim 1, further comprising: a cover member, the cover member being adapted to cover a portion where the water separator is mounted and expose the portion where the water separator is mounted.

3. The personal watercraft according to claim 2, wherein, when the cover member covers the portion where the water separator is mounted, the cap member is in contact with a inner face of the cover member or in close proximity to the inner face of the cover member with a slight gap.

4. A personal watercraft comprising:

an internal combustion engine;

a fuel tank for reserving fuel supplied to the internal combustion engine;

an air-fuel mixture generating means for mixing the fuel from the fuel tank with air to generate air-fuel mixture;

a fuel supply passage connecting the fuel tank to the air-fuel mixture generating means; and a water separator provided in the fuel supply passage, said watercraft further comprising: a body member provided with an opening capable of being covered and uncovered, wherein the water separator is removably mounted inside of the body member in the vicinity of the opening, and the water separator comprises a container for reserving the fuel, and a cap member removably attached to the container, for covering an opening in the container.

5. A personal watercraft comprising:

an internal combustion engine;

a fuel tank for reserving fuel supplied to the internal combustion engine;

an air-fuel mixture generating means for mixing the fuel from the fuel tank with air to generate air-fuel mixture;

a fuel supply passage connecting the fuel tank to the air-fuel mixture generating means; and a water separator provided in the fuel supply passage, said watercraft further comprising:

a discharge passage; and an opening/closing means for opening/closing the discharge passage, wherein the water separator has a container for reserving the fuel, and the discharge passage is provided at a bottom of the container.

6. The personal watercraft according to claim 5, further comprising:

a biasing means for biasing the opening/closing means to be at a closed position; and an operating means for opening the opening/closing means against a biasing force of the biasing means.

* * * * *